US007364485B2

(12) United States Patent
Kameoka

(10) Patent No.: US 7,364,485 B2
(45) Date of Patent: Apr. 29, 2008

(54) OUTBOARD MOTOR HAVING A COWLING

(75) Inventor: Kentaro Kameoka, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/320,371

(22) Filed: Dec. 28, 2005

(65) Prior Publication Data

US 2006/0141877 A1 Jun. 29, 2006

(30) Foreign Application Priority Data

Dec. 28, 2004 (JP) ..... 2004-381541

(51) Int. Cl.
*B63H 20/32* (2006.01)

(52) U.S. Cl. ..... 440/77

(58) Field of Classification Search ..... 440/76, 440/77; 123/195 P

See application file for complete search history.

(56) References Cited

U.S. PATENT DOCUMENTS 4,930,790 A * 6/1990 Sheridan ..... 277/630
5,018,998 A 5/1991 Kato
5,025,763 A 6/1991 Watanabe
5,055,074 A 10/1991 Westberg et al.
5,096,208 A * 3/1992 Westberg ..... 277/641
5,135,239 A * 8/1992 Kato et al. ..... 277/645
5,487,687 A 1/1996 Idzikowski et al.
6,190,219 B1 * 2/2001 Meier et al. ..... 440/77
6,699,083 B2 * 3/2004 Rinzaki et al. ..... 440/77
6,875,066 B2 4/2005 Wolaver

FOREIGN PATENT DOCUMENTS

JP 02-292575 12/1990
JP 05-162692 6/1993
JP 2002-240786 8/2002
JP 2002-349257 12/2002

* cited by examiner

*Primary Examiner*—Ed Swinehart
(74) *Attorney, Agent, or Firm*—Knobbe, Martens, Olson & Bear, LLP

(57) ABSTRACT

An outboard motor 1 has a cowling 10 of a two-piece structure including a top cowl 11 and a bottom cowl 12. Mating portions of the top and bottom cowls include a watertight seal. A first, horizontally-directed sealing portion is not visible from outside the cowling. A second, vertically-directed sealing portion is positioned inwardly from the first sealing portion. In some embodiments, an elongate rib depends from the top cowl generally into the bottom cowl. In other embodiments, the second sealing portion is positioned generally above the first sealing portion.

14 Claims, 7 Drawing Sheets

OUTBOARD MOTOR HAVING A COWLING

CROSS-REFERENCE TO RELATED APPLICATIONS

This application claims priority to Japanese Patent Application No. 2004-381541, which was filed on Dec. 28, 2004. The entirety of the priority application is hereby incorporated by reference.

BACKGROUND OF THE INVENTION

1. Field of the Invention

The present invention relates to an outboard motor, and more specifically to an outboard motor having a cowling comprising two mating portions.

2. Description of the Related Art

Conventionally, an outboard motor has a sealed structure, in which almost all portions of the outboard motor including the engine are covered with a cover, since the outboard motor is exposed to the weather, seawater or the like when in use. Problems caused by the entry of water into the outboard motor are thereby minimized or prevented.

The engine disposed upward of the outboard motor is typically enclosed within a cowling made up of a bottom cowl and a removable top cowl. Mating portions of the top and botttom cowls generally are provided with a sealing member to protect against water intrusion between the mating portions.

Japanese Publication No. 2002-240786 discloses an engine cover for an outboard motor in which a sealing member is attached to a bottom edge of a top cover. The sealing member engages a sealing surface formed on the bottom cover. The sealing surface is vertically below the top cover bottom edge. A lip piece also extends inwardly to effect a further seal with the bottom cover. This second seal is generally horizontally directed. However, the seal member is clearly visible from outside the cowling, and thus detracts from the appearance of the motor. Further, it is anticipated that repeated removal and reinstallation of the top cowling could cause premature wear of the generally-horizontally disposed lip.

Japanese Publication No. 05-162692 discloses an outboard motor cowling comprising a top cowl that is removably mounted to a bottom cowl. A seal rubber is provided on the bottom cowl's upper edge. A first lip of the seal rubber establishes a radial seal between the top and bottom cowls. A second lip creates a seal between the top and bottom cowls in a vertical direction. However, the seal rubber is visible from outside the cowling, and thus detracts from the appearance of the motor. Further, the first lip appears somewhat flimsy, and repeated removal and reinstallation of the top cowling could cause premature wear.

Japanese Publication No. 02-292575 discloses a top cowl that may be removably mounted to a bottom cowl. A seal member is arranged on the top cowl in a position that is clearly visible from outside the cowling. Two ring-shaped portions establish seals in a vertical direction along two surfaces. Sealing in only one direction may reduce the effectiveness of the seal, and may make the seal more vulnerable to interference from engine vibrations or manufacturing variances in the size of cowling members.

SUMMARY OF THE INVENTION

There is thus a need for an outboard motor having a cowling capable of providing good sealing performance even when the cowling is impacted by a strong wave, when the pressure in the cowling is changed with the operation of the engine, if there are strong engine vibrations, and when there are variations in size of the top cowl and the bottom cowl. Also, there is a need for a cowling in which the seal does not detract from the appearance of the motor.

In accordance with one embodiment, the present invention provides an outboard motor comprising a cowling having a top cowl and a bottom cowl adapted to be joined together. The top cowl comprises a mating portion adapted to releasably mate with a corresponding mating portion of the bottom cowl. A sealing structure is configured to create a generally watertight seal between the mating portions when the top and bottom cowls are joined together. The sealing structure comprises a generally vertically-directed sealing portion and a generally horizontally-directed sealing portion. The sealing portions are adapted to create generally watertight seals, wherein the vertically-directed sealing portion is disposed generally above the horizontally-directed sealing portion when the top and bottom cowls are joined together In accordance with another embodiment, a first elastomeric sealing member is disposed on the top cowl and effects the vertically-directed seal, and a second elastomeric sealing member is disposed on the bottom cowl and effects the horizontally-directed seal. In yet another embodiment, the first sealing member comprises an elongate rib that extends downwardly, the rib being positioned generally inside the bottom cowl when the top and bottom cowls are joined together. In a further embodiment, the sealing portions are and visible from a position outside the cowling and at or above the mating portions.

In accordance with another embodiment, an outboard motor is provided comprising a cowling having a top cowl and a bottom cowl adapted to be joined together. The top cowl comprises a mating portion adapted to releasably mate with a corresponding mating portion of the bottom cowl. A sealing structure is configured to create a generally watertight seal between the mating portions when the top and bottom cowls are joined together. The sealing structure comprises a generally vertically-directed sealing portion and a generally horizontally-directed sealing portion. The sealing portions are adapted to create generally watertight seals. The vertically-directed sealing portion is arranged generally inwardly relative to the horizontally-directed sealing portion when the top and bottom cowls are joined together.

DETAILED DESCRIPTION OF PREFERRED EMBODIMENTS

Figure 1:
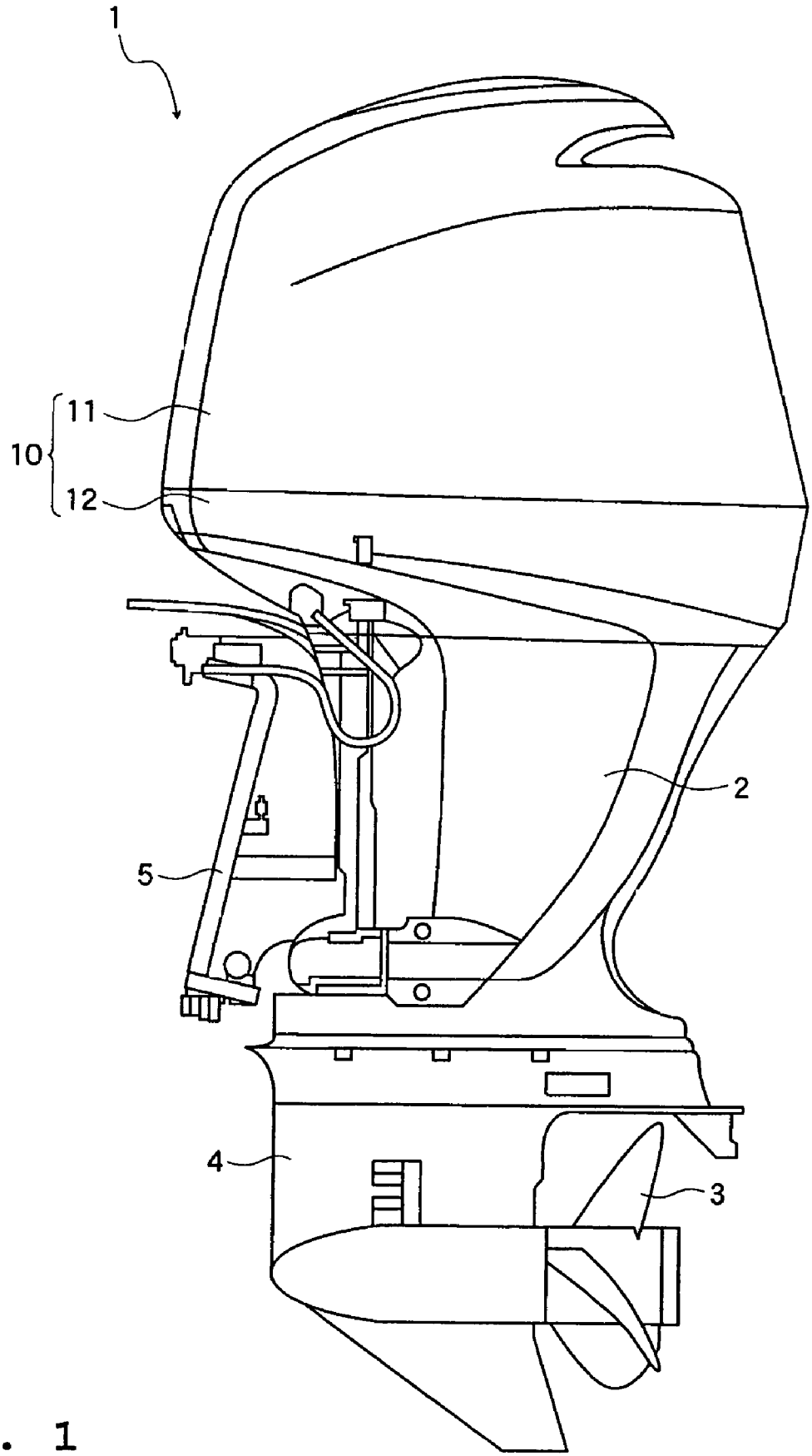
FIG. 1 is a side view, showing the construction of an outboard motor in accordance with an embodiment of the present invention.

With initial reference to FIG. 1, an outboard motor 1 has a drive shaft housing 2, a gear casing 4, a cowling 10, and a mounting metal fitting 5. The gear casing 4 house a gear mechanism for driving a propeller 3 for rotation and is coupled to a bottom portion of the drive shaft housing 2. The cowling 10 houses an engine and is disposed on top of the drive shaft housing 2. The mounting metal fitting 5 is disposed forward of the drive shaft housing 2. The outboard motor 1 is mounted to a hull (not shown) with the mounting metal fitting 5.

Figure 2:
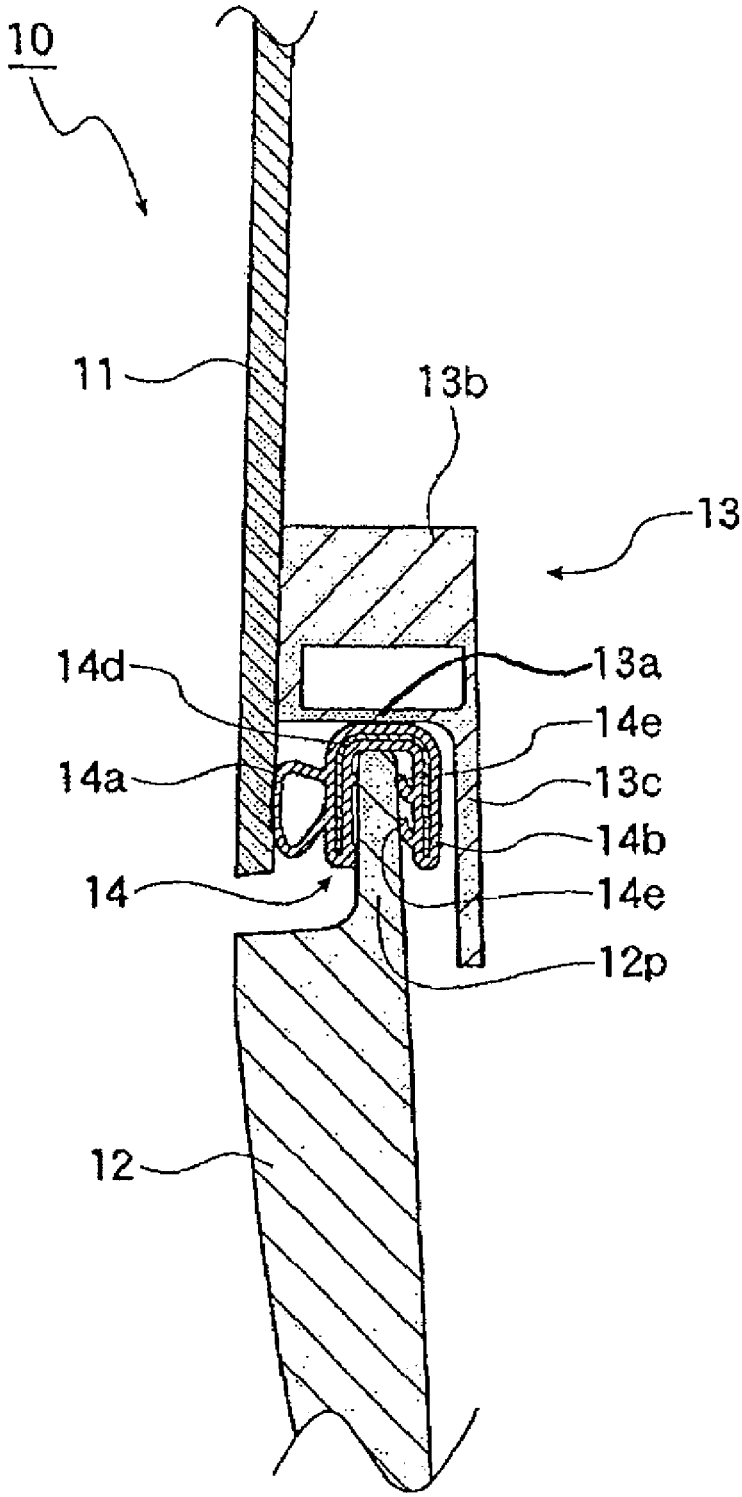
FIG. 2 is an enlarged partial sectional view showing the mating and sealing structure of a cowling in accordance with an embodiment.

With additional reference to FIG. 2, the cowling 10 of the outboard motor preferably has a two-piece structure including a top cowl 11 and a bottom cowl 12. Mating portions of the top cowl 11 and the bottom cowl 12 cooperate so that the top cowl 11 is removably mountable onto the bottom cowl 12. Preferably, a clamping structure is provided to securely hold the top cowl in place mated with the bottom cowl 12. More preferably, the mating portions of the top and bottom cowls preferably include a sealing structure adapted to create a generally watertight seal when the top and bottom cowls are joined together.

In the illustrated embodiment, a top-side sealing member 13 is a first sealing member disposed on the inner face of the top cowl 11 and close to the bottom end therof. A bottom-side sealing member 14 is a second sealing member, and is provided at the top end 12*p* of the bottom cowl 12.

The top-side sealing member 13 preferably has an L-shaped cross section and is adhered to the inner face of the top cowl 11 and close to the bottom end thereof. The top-side sealing member 13 includes a support portion 13*b*, a vertically-directed sealing portion 13*a* disposed in the support portion 13*b* for vertically sealing the top cowl 11 and the bottom cowl 12, and an elongate rib 13*c* that extends downward from the support portion 13*b* inside the top cowl 11 and into the bottom cowl 12. The rib 13*c* generally covers a side part of the top end 12*p* of the bottom cowl 12, which is disposed below the top cowl 11.

In the present specification, the term "adhere" is a broad term, and includes, without limitation, bonding, fixing or coupling members together without using mechanical-type fasteners such as bolts. Adhering can include using adhesives such as glues, but can also include welding or the like.

Additionally, in the present specification, a "vertical" seal refers to a sealing structure in which a sealing member extends generally vertically to engage an opposing surface to effect a seal. Similarly, a "horizontal" seal refers to a sealing structure in which a sealing member extends generally horizontally to engage an opposing surface to effect a seal. It is to be understood that the terms "vertical" and "horizontal" in this context should be broadly considered to correspond to structures that are generally disposed in these directions.

With reference again to FIG. 2, the vertical sealing portion 13*a* preferably has a generally hollow structure. The rib 13*c* extends downwardly from a position generally inwardly from the portion 13*a* so as to be generally adjacent the upper end of the bottom cowl 12. Preferably the rib 13*c* extends downwardly so that a lower end of the rib is lower than the bottom edge of the top cowl 11. In one embodiment, the vertical sealing portion 13*a* is formed of an elastomeric material such as rubber or polymeric materials.

The bottom-side sealing member 14 preferably is made of an elastomeric material such as rubber. The bottom-side sealing member 14 includes a horizontal sealing portion 14*a* for horizontally sealing the top cowl 11 and the bottom cowl 12. The horizontal sealing portion 14*a* preferably has a hollow shape for engaging and sealing the bottom end of the top cowl 11.

A clip portion 14*b* has a generally squared U shaped cross section, into which the top end 12*p* of the bottom cowl 12 is fitted. The clip portion 14*b* preferably has a metal core member 14*d* therein. Pressing-contact lip parts 14*e* are formed on the inner face of the clip portion 14*b* defining an opening so that the clip portion 14*b* can be securely held to the top end 12*p* of the bottom cowl 12 with the pressing-contact lip parts 14*e*. The horizontal sealing portion 14*a* is disposed outside of the outer periphery of the clip portion 14*b*, and formed to horizontally seal the top cowl 11 and the bottom cowl 12 as the horizontal sealing portion 14*a* abuts against the inner face of the bottom end of the top cowl 11.

The top cowl 11 and the bottom cowl 12 are also vertically sealed as the clip portion 14*b* having the downward opening is fitted onto the top end 12*p* of the bottom cowl 12 and then the vertical sealing portion 13*a* of the top-side sealing member 13 abuts against the clip portion 14*b* from above.

As shown in FIG. 2, when the top cowl 11 and the bottom cowl 12 are joined to each other, the vertical sealing portion 13*a* is located generally above and inside of the horizontal sealing portion 14*a*.

In operation, it is anticipated that the water in which the outboard motor is being operated, such as seawater, will splash onto the cowling 10. As the cowling 10 receives a strong wave impact, seawater attempts to enter the cowling 10 through a gap between the top cowl 11 and the bottom cowl 12, but is blocked from entering the cowling 10 by the horizontal sealing portion 14*a*, which is in contact with the bottom end of the top cowl 11.

A portion of the seawater may not be blocked by the horizontal seal 14*a*, but is then blocked by the vertical sealing portion 13*a* of the top-side sealing member 13, which is in contact with the clip portion 14*b* of the bottom-side sealing member 14.

Even though the vertical seal 13*a* may block splashing water from passing thereby and into the cowling 10, a negative pressure may be produced in the cowling 10 because of operation of the engine. As such, some water may be drawn past the negative seal by the negative pressure. However, such water will run down along the splash-proof rib 13*c* and onto the inner face of the bottom cowl 12 with the sway of the hull and runs down along the inner face of the bottom cowl 12. Therefore, seawater that may enter the cowling 10 when the cowling 10 (either by wave action and/or by negative pressure within the cowling 10, is prevented from splashing onto the engine and other devices in the cowling 10 by the rib 13*c*.

Since the cowling 10 is provided with the vertical sealing portion 13*a* for vertically sealing the top cowl 11 and the bottom cowl 12, and the horizontal sealing portion 14*a* for horizontally sealing the top cowl 11 and the bottom cowl 12, the top cowl 11 and the bottom cowl 12 are sealed both vertically and horizontally. Therefore, good sealing performance can be provided even when the cowling 10 receives a strong wave impact or a negative pressure is produced in the cowling 10, as well as when there may be variations in size of the top cowl 11 and the bottom cowl 12, generally due to manufacturing variances.

Further, since the top cowl 11 and the bottom cowl 12 are sealed both vertically and horizontally, good sealing performance is maintained even after much wear and tear, such as repeated removal and reinstallation of the top cowl 11, and vibration.

Further, since the vertical sealing portion 13*a* is located above the horizontal sealing portion 14*a*, the seawater that attempts to enter the cowling 10 as the cowling 10 receives a strong wave is first blocked horizontally and then blocked vertically, contrary to the conventional art where the sea water is first blocked vertically and then blocked horizontally. As such, the vertical sealing portion 13*a* is not exposed to the outside. This assists in resisting corrosion or aging due to exposure to the elements, such as the sun, and also enhances the appearance of the outboard motor, because the neither the vertical nor horizontal seals are visible from outside the motor. At the least, the seals are not visible from an angle at or above the bottom edge of the top cowling 11.

Further, there are provided the top-side sealing member 13 having the vertical sealing portion 13*a* and the bottom-side sealing member 14 having the horizontal sealing portion 14*a*, and the top-side sealing member 13 is disposed on the top cowl 11 and the bottom-side sealing member 14 is disposed on the bottom cowl 12. Since a sealing member has a two-piece structure including the top-side sealing member 13 and the bottom-side sealing member 14, in case of deterioration or damage of the sealing member, only a relevant one of the top-side sealing member 13 and the bottom-side sealing member 14 will likely need replacement, thereby reducing the cost of maintenance.

Further, the bottom-side sealing member 14 has the clip portion 14*b* of a generally squared U shape in cross section, and the clip portion 14*b* having the downward opening is fitted onto the top end 12*p* of the bottom cowl 12. Thus, when the clip portion 14*b* of a generally squared U shape in cross section is made of an elastic material such as rubber and fitted onto the top end 12*p* of the bottom cowl 12, the top cowl 11 can be easily mounted on the bottom cowl 12. Therefore, there is no need to significantly change the shape of the top end 12*p* of the bottom cowl 12 to seal the top cowl 11 and the bottom cowl 12.

Further, the top-side sealing member 13 seals the top cowl 11 and the bottom cowl 12 as the vertical sealing portion 13*a* abuts against the clip portion 14*b* of the bottom-side sealing member 14. In the case of using an elastic member as the bottom-side sealing member 14, the top cowl 11 and the bottom cowl 12 are sealed with the clip portion 14*b* being in pressing contact with the vertical sealing portion 13*a*, thereby bringing the clip portion 14*b* and the vertical portion 13 into closer contact with each other and thus improving the sealing performance.

Figure 3:
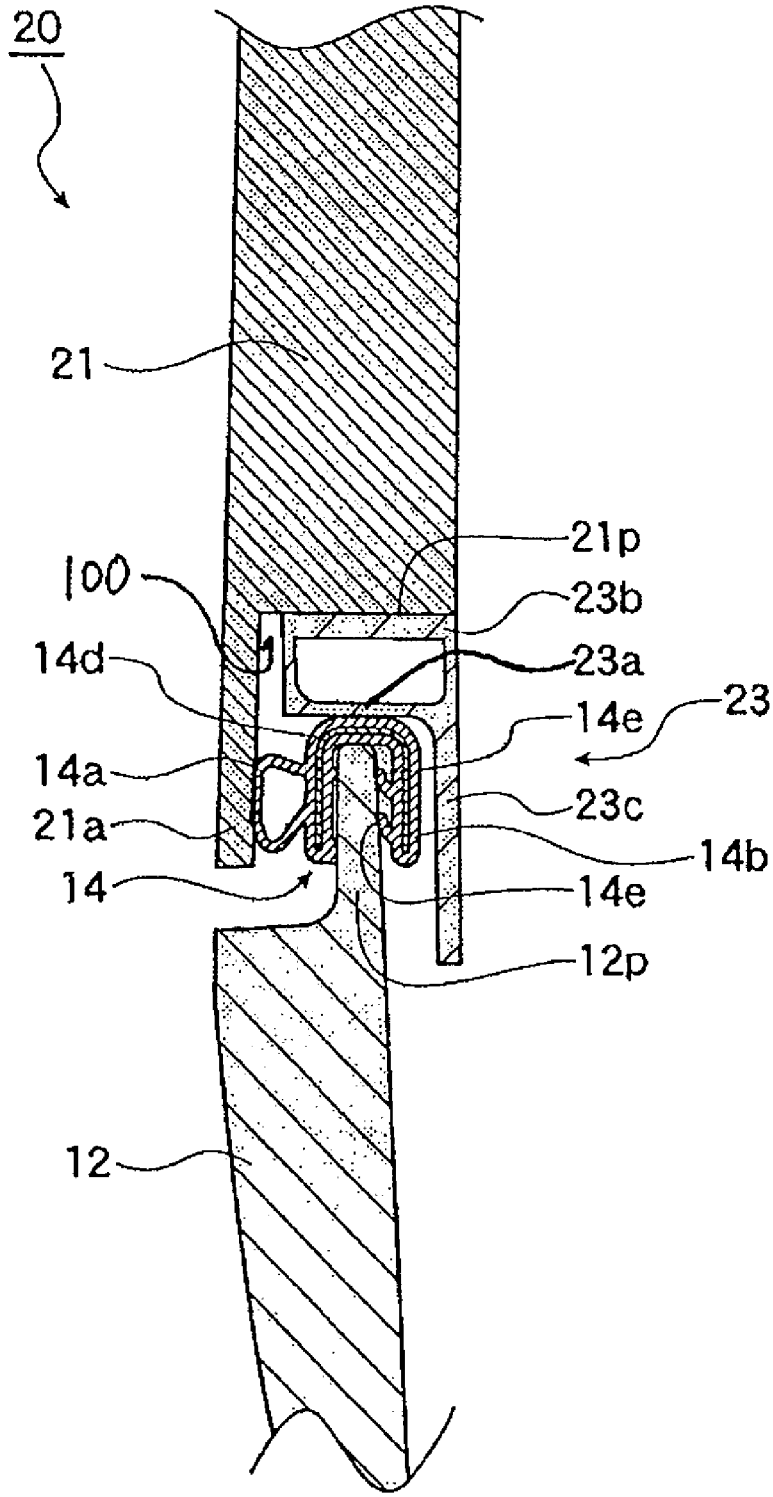
FIG. 3 is an enlarged partial sectional view showing the mating and sealing structure of a cowling in accordance with another embodiment.

With reference next to FIG. 3, in another embodiment a top cowl 21 has a thickness larger than that of the top cowl 11 of FIG. 2; an opposing face 21*p*, which preferably is a flat surface that is generally perpendicular to the generally vertical inner face of the top cowl 21, is formed on the inner face of the top cowl 21 and close to the bottom end thereof; and a top-side sealing member 23 is a first sealing member and is disposed on the opposing face 21*p*.

As shown in FIG. 3, a cowling 20 of the outboard motor 1 has a recess 100 of a certain depth formed on the inner face of the top cowl 21 and close to the bottom end thereof. The opposing face 21*p*, which is a flat surface and is generally perpendicular to the vertical inner face of the top cowl 21, is formed on the recess. The opposing face 21*p* is formed to oppose the top end 12*p* of the bottom cowl 12 when the top cowl 21 and the bottom cowl 12 are joined to each other.

As the recess 100 of a certain depth is formed on the inner face of the top cowl 21 and close to the bottom end thereof, a projecting portion 21*a* is defined at the bottom end of the top cowl 21 to be generally parallel to the vertical inner face of the top cowl 21.

The top-side sealing member 23 preferably has an L-shaped cross section, and is fixed to the opposing face 21*p*. The top-side sealing member 23 includes a vertical sealing portion 23*a* for vertically sealing the top cowl 21 and the bottom cowl 12, a support portion 23*b* having the vertical sealing portion 23*a* and fixed to the opposing face 21*p*, and a splash-proof rib 23*c* extending downward from the support portion 23*b* inside the top cowl 21. In the illustrated embodiment the sealing member 23 preferably is adhered to the face 21*p*. It is to be understood that, in other embodiments, the sealing member 23 can be connected to the face 21*p* via a mechanical fastener such as a screw. Preferably, however, the fastener does not penetrate through the top cowling 11 so as to be exposed to the outside.

In the cowling 20, preferably the opposing face 21*p* opposing the top end of the bottom cowl 12 when the top cowl 21 and the bottom cowl 12 are joined to each other is formed on the top cowl 21 and close to the bottom end thereof, and the top-side sealing member 23 is disposed on the opposing face 21*p*. The cowling 20, therefore, provides the following advantage. More specifically, when the opposing face 21*p* formed on the top cowl 21 and close to the bottom end thereof and opposing the top end 12*p* of the bottom cowl 12 is defined by a flat surface generally perpendicular to the vertical inner face of the top cowl 21, the top-side sealing member 23 disposed on the flat opposing face 21*p* becomes generally perpendicular to the vertical inner face of the top cowl 21. Thus, as the bottom-side sealing member 14 as disposed on the bottom cowl 12 presses against the top-side sealing member 23, a vertical force is applied to the top-side sealing member 23. The face 21*p* directly supports the sealing member 23, and thus prevents application of shear loads that could potentially rip the top-side sealing member 23 off the top cowl 21.

In the illustrated embodiment, the opposing face 21*p* is a flat surface generally perpendicular to the vertical inner face of the top cowl 21, and the top-side sealing member 23 is disposed on the opposing face 21*p*. However, it is to be understood that the shape of a portion of the top-side sealing member 23 where it abuts against the clip portion 14*b*, as well as the shape and disposition of the opposing face 21*p* may be modified as long as the clip portion 14*b* abuts against the top-side sealing member 23 to seal the top cowl 21 and the bottom cowl 12. Thus, in other embodiments, the face 21*p* may not be substantially perpendicular to the inner face of the top cowl. However, preferably the face 21*p* extends at least partially in such a perpendicular direction.

For example, the portion of the top-side sealing member 23 where it abuts against the clip portion 14*b* may be formed with a recess of a certain depth for receiving a top portion of the clip portion 14*b*. As the top portion of the clip portion 14*b* is fitted into the recess, a larger area of the clip portion 14*b* comes into close contact with the top-side sealing member 23, so that it is possible to improve the vertical sealing performance.

Alternatively, the opposing face 21*p* may be formed with a recess of a certain depth for receiving the support portion 23*b* of the top-side sealing member 23, in which case the support portion 23*b* of the top-side sealing member 23 may be adhered to the recess. In additional embodiments, the face 21*p* may be contoured. Preferably the sealing member support portion 23*b* is shaped to complement the face 21*p* contour. Thus the sealing member is supported longitudinally and transversely by the face 21*p*.

Figure 4:
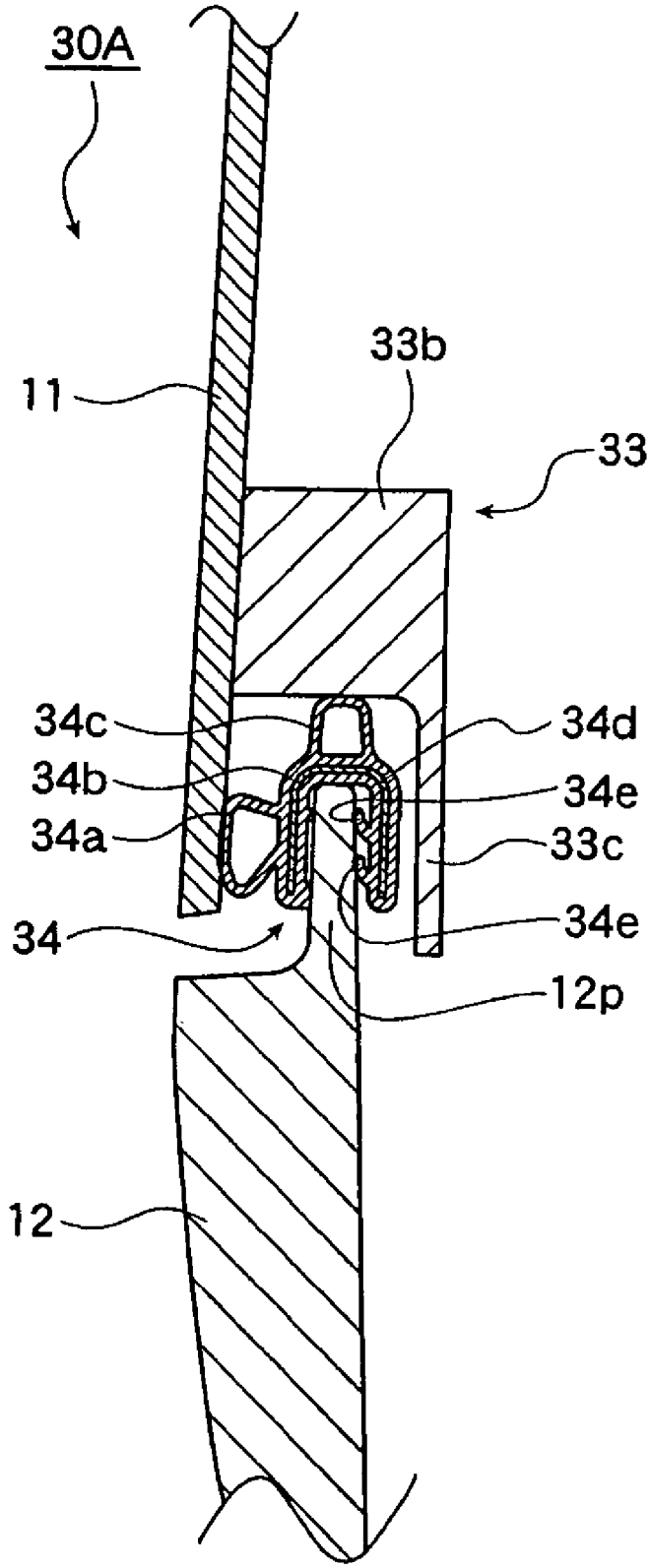
FIG. 4(A) is an enlarged partial sectional view showing the mating and sealing structure of a cowling in accordance with still another embodiment.
FIG. 4(B) is an enlarged partial sectional view showing the mating and sealing structure of a cowling in accordance with yet another embodiment.
FIG. 4(C) is an enlarged partial sectional view showing the mating and sealing structure of a cowling in accordance with a further embodiment.
FIG. 4(D) is an enlarged partial sectional view showing the mating and sealing structure of a cowling in accordance with a still further embodiment.
Figure 4:
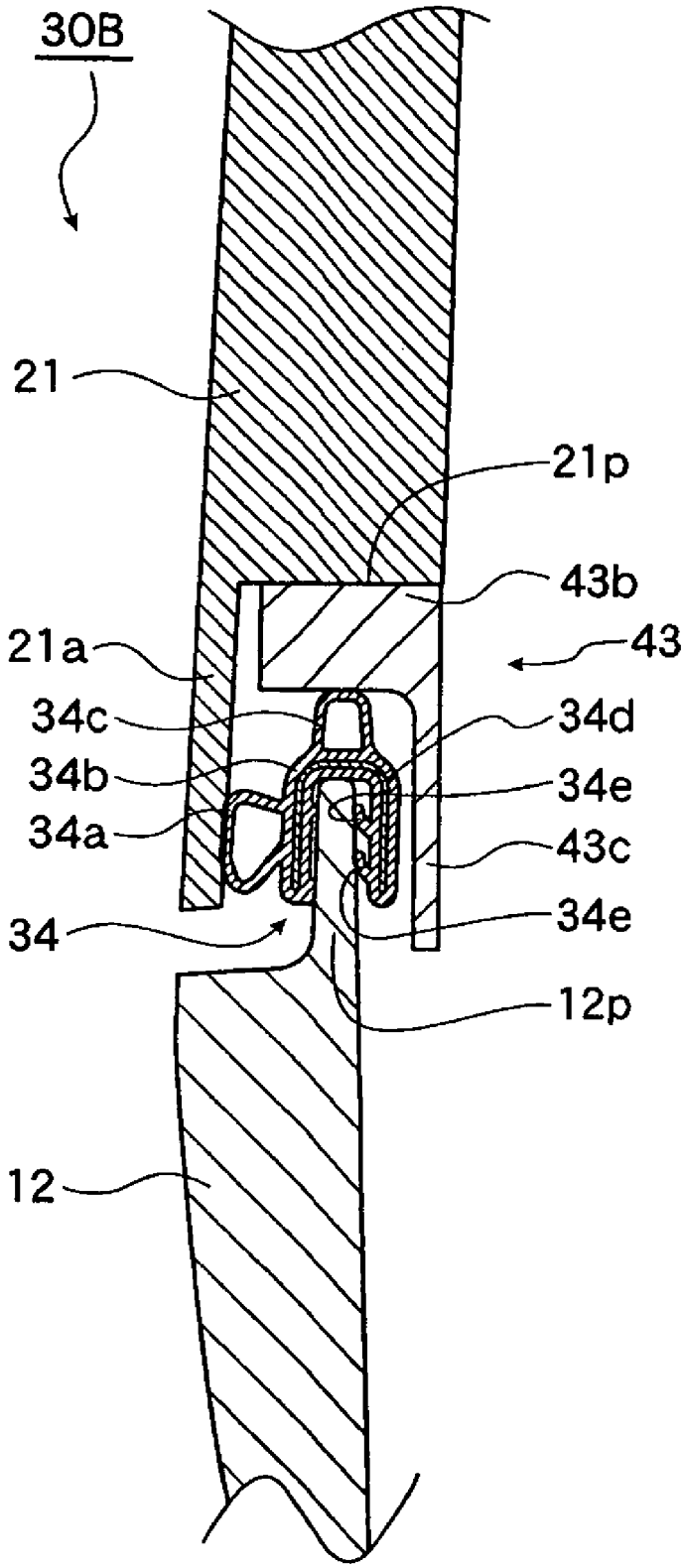
Figure 4:
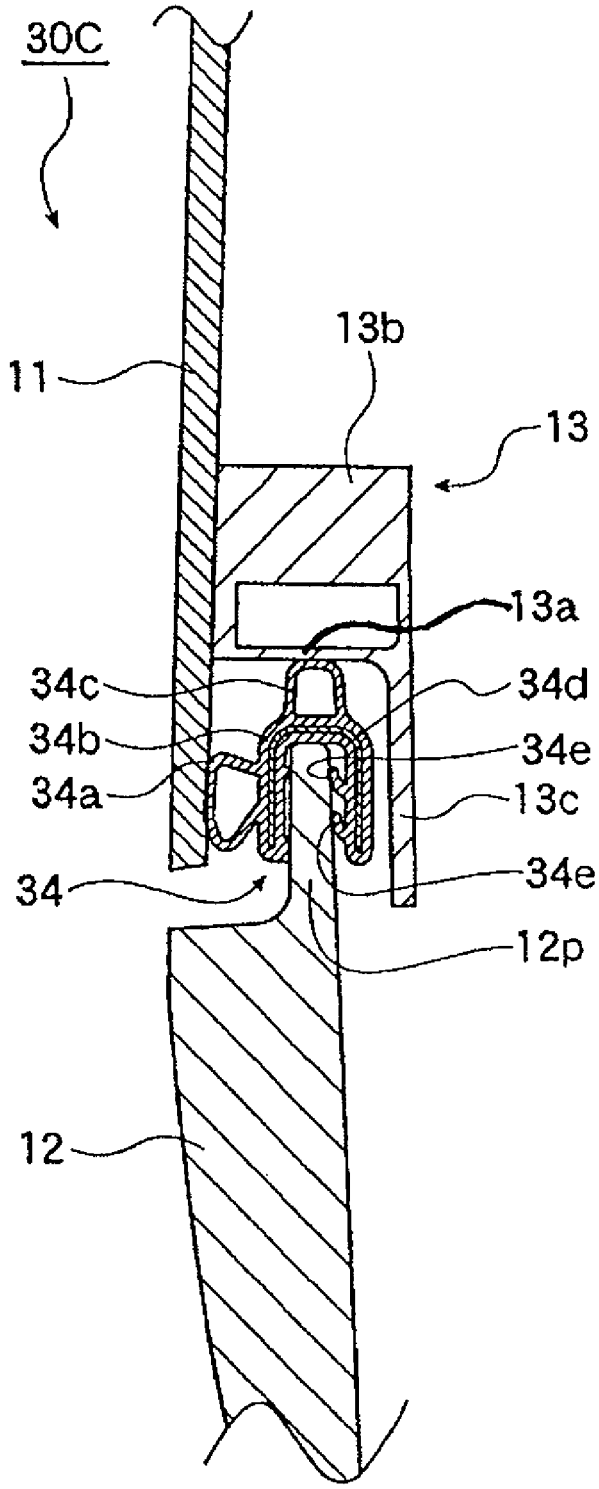
Figure 4:
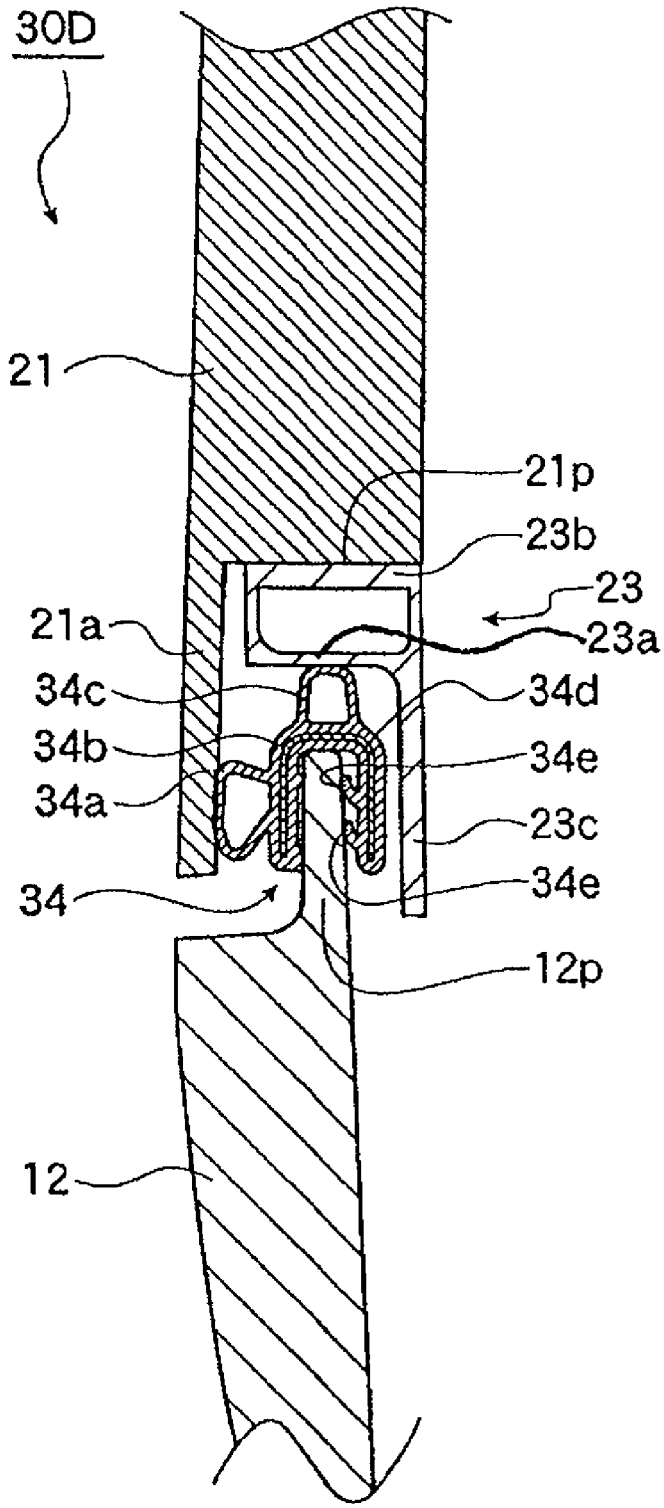

With reference next to FIG. 4(A), another embodiment is illustrated in which: the bottom cowl 12 is provided with an integral sealing member 34; and the top cowl 11 is provided with a top-side pressing-contact member 33 that does not have the vertical sealing portion 13*a* (23*a*) of FIGS. 2 and 3.

A cowling 30A is constructed such that the integral sealing member 34 is fitted onto the top end 12*p* of the bottom cowl 12, and the top cowl 11 provided with the top-side pressing-contact member 33 is mounted on the bottom cowl 12 with the integral sealing member 34 fitted. Preferably the contact member 33 comprises an elastomeric material. However, other materials, and even substantially rigid materials, may be used to construct the contact member 33.

As shown in FIG. 4(A), the integral sealing member 34 preferably is obtained by integrally forming a clip portion 34*b* of a generally squared U shape in cross to the bottom cowl 12, a vertical sealing portion 34*c*, and a horizontal sealing portion 34*a*.

The clip portion 34*b* preferably has a metal core member 34*d* therein. Pressing-contact lip parts 34*e* are formed on the inner face of the clip portion 34*b* defining an the clip portion 34*b* can be held securely to the top end 12*p* of the bottom cowl 12 with the pressing-contact lip parts 34*e*.

In the cowling 30A, the integral sealing member 34 has the clip portion 34*b* of a generally squared U shape in cross section fitted onto the bottom cowl 12, and the clip portion 34*b*, vertical sealing portion 34*c*, and horizontal sealing portion 34*a* are formed together. Thus, only one member for sealing is required, thereby simplifying the structure and reducing the number of parts.

Further, the integral sealing member 34 is disposed on the bottom cowl 12. This allows preventing the member for sealing from coming off when the top cowl 11 (21) is removed, as well as reducing the top cowl 11 (21) in weight.

In accordance with this embodiment, the cowling 30A is constructed such sealing member 34 is fitted onto the top end 12*p* of the bottom cowl 12, and the top cowl 11 is provided with the top-side pressing-contact member 33 mounted on the integral sealing member 34 fitted on the bottom cowl 12.

With next reference to FIG. 4(B), in another embodiment of a cowling 30B, it is possible to seal the top cowl 21 and the bottom cowl 11 such that the integral sealing member 34 is fitted onto the top end 12*p* of the bottom cowl 12. A top cowl 21 having a thickness larger than that of the top cowl 11 of FIG. 4(A) is mounted on the integral sealing member 34 fitted on the bottom cowl 12. The top cowl 21 has an opposing face 21*p*, and a top-side pressing-contact member 43 is disposed on the opposing face 21*p*.

With next reference to an additional embodiment of a cowling 30C as shown in FIG. 4(C), it is possible to seal the top cowl 11 and the bottom cowl 12 such that the integral sealing member 34 is fitted onto the top end 12*p* of the bottom cowl 12, the top cowl 11 is mounted on the integral sealing member 34 fitted on the bottom cowl 12, the top cowl 11 preferably does not have an opposing face 21*p* as in FIG. 4(B), and a top-side sealing member 13 is used in place of the top-side pressing-contact member 33.

With next reference to the embodiment of a cowling 30D as shown in FIG. 4(D), it is possible to seal the top cowl 21 and the bottom cowl 12 such that the integral sealing member 34 is fitted onto the top end 12*p* of the bottom cowl 12. In this embodiment, the top cowl 21 has a thickness larger than that of the top cowl 11 of FIG. 4(C), and includes a face 21*p*. A top-side sealing member 23 is disposed on the opposing face 21*p*.

In the embodiments illustrated in FIGS. 4(A)-(D), the top cowl 11(21) preferably is provided with the top-side pressing-contact member 33(43) or top-side sealing member 13(23), and a portion of the top-side pressing-contact member 33(43) or top-side sealing member 13(23) where it abuts against the vertical sealing portion 34*c* is generally perpendicular to the vertical inner face of the top cowl 11(21). However, other arrangements are contemplated.

For example, the portion of the top-side pressing-contact member 33(43) or top-side sealing member 13(23) where it abuts against the vertical sealing portion 34*c* may be formed with a recess of a certain depth for receiving a top portion of the vertical sealing portion 34*c*. As the top portion of the vertical sealing portion 34*c* is fitted into the recess, a larger area of the vertical sealing portion 34*c* comes into close contact with the top-side pressing-contact member 33(43) or top-side sealing member 13(23), so that it is possible to improve the vertical sealing performance.

Alternatively, the opposing face 21*p* may be formed with a recess of a certain depth for receiving a support portion 33*b*(43*b*) of the top-side pressing-contact member 33(43), in which case the support portion 33*b*(43*b*) of the top-side pressing-contact member 33(43) is adhered to the recess.

In the embodiments discussed above, the bottom-side sealing member 14 or the integral sealing member 34 is disposed on the bottom cowl 12. However, other arrangements may be contemplated. For example, in other embodiments, the member 13(23) or 33(43) provided on the top cowl 11(21) and the bottom-side member 14(34) provided on the bottom cowl 12 may be switched with each other as long as the top cowl 11(21) and the bottom cowl 12 are sealed as discussed above.

In other words, it is possible to construct such that the bottom-side sealing member 14 or integral sealing member 34 is disposed on the top cowl 11 and the top-side sealing member 13(33) is disposed on the bottom cowl 12; or the bottom-side sealing member 14 or integral sealing member 34 is disposed on the top cowl 21 and the top-side sealing member 23(43) is disposed on the bottom cowl 12. Also, it is possible to construct such that the integral sealing member 34 is disposed on the top cowl 11(21) and the top-side pressing-contact member 33(43) is disposed on the bottom cowl 12.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a cowling having a top cowl and a bottom cowl adapted to be joined together, the top cowl comprising a mating portion adapted to releasably mate with a corresponding mating portion of the bottom cowl, a sealing structure configured to create a generally watertight seal between the mating portions when the top and bottom cowls are joined together, wherein the sealing structure comprises a generally vertically-directed sealing portion for creating a generally watertight seal with a generally horizontal surface of the cowling and a generally horizontally-directed sealing portion for creating a generally watertight seal with a generally vertical surface of the cowling, wherein the vertically-directed sealing portion is disposed generally above the horizontally-directed sealing portion when the top and bottom cowls are joined together, wherein a first elastomeric sealing member is disposed on the top cowl and comprises the vertically-directed sealing portion, and a second elastomeric sealing member is disposed on the bottom cowl and comprises the horizontally-directed sealing portion.

2. The outboard motor of claim 1, wherein the first sealing member additionally comprises an elongate rib that extends downwardly, the rib being positioned generally inside the bottom cowl when the top and bottom cowls are joined together.

3. The outboard motor of claim 2, wherein a distal end of the elongate rib extends downwardly farther than a bottom edge of the top cowling.

4. The outboard motor of claim 1, wherein the first sealing member is adhered to an inner surface of the top cowl.

5. The outboard motor of claim 4, wherein the top cowl comprises a face that generally opposes a top edge of the bottom cowl when the top and bottom cowls are joined together, and the first sealing member is disposed on the opposing face.

6. The outboard motor of claim 4, wherein the sealing members are not visible from a position outside the cowling and at or above the mating portions.

7. The outboard motor of claim 1, wherein the top cowl comprises a face that generally opposes a top edge of the bottom cowl when the top and bottom cowls are joined together, and the first sealing member is disposed on the opposing face.

8. The outboard motor of claim 1, wherein the second sealing member comprises a generally U-shaped clip having a downwardly-directed opening, the clip being fitted onto a top edge of the bottom cowl.

9. The outboard motor of claim 8, wherein the generally vertically-directed sealing portion of the first sealing member creates the generally water tight seal as the vertically-directed sealing portion abuts against the clip of the second sealing member.

10. An outboard motor comprising a cowling having a top cowl and a bottom cowl adapted to be joined together, the top cowl comprising a mating portion adapted to releasably mate with a corresponding mating portion of the bottom cowl, a sealing structure configured to create a generally watertight seal between the mating portions when the top and bottom cowls are joined together, wherein the sealing structure comprises a generally vertically-directed sealing portion for creating a generally watertight seal with a generally horizontal surface of the cowling and a generally horizontally-directed sealing portion for creating a generally watertight seal with a generally vertical surface of the cowling, the vertically-directed sealing portion being arranged generally inwardly relative to the horizontally-directed sealing portion when the top and bottom cowls are joined together, wherein the sealing portions are not visible from a position outside the cowling, at or above the mating portions, and where the mating portions are visible, and wherein a first elastomeric sealing member comprises the vertically-directed sealing member and is disposed on the top cowl, and a second elastomeric sealing member comprises the horizontally-directed sealing member and is disposed on the bottom cowl.

11. The outboard motor of claim 10, wherein the first sealing member is adhered to the top cowl.

12. The outboard motor of claim 10, wherein the first sealing member comprises an elongate rib that extends downwardly, the rib being positioned generally inside the bottom cowl when the top and bottom cowls are joined together.

13. The outboard motor of claim 12, wherein a distal end of the elongate rib extends downwardly farther than a bottom edge of the top cowling.

14. The outboard motor of claim 10, wherein the top cowl comprises a face that generally opposes a top edge of the bottom cowl when the top and bottom cowls are joined together, and the first sealing member is disposed on the opposing face.

* * * * *

UNITED STATES PATENT AND TRADEMARK OFFICE

CERTIFICATE OF CORRECTION

PATENT NO. : 7,364,485 B2
APPLICATION NO. : 11/320371
DATED : April 29, 2008
INVENTOR(S) : Kentaro Kameoka It is certified that error appears in the above-identified patent and that said Letters Patent is hereby corrected as shown below:

At column 1, line 27, please delete “botttom” and insert therefore, -- bottom --.

At column 2, line 21, after “together”, insert therefore, -- . --.

At column 2, line 31, please delete “and” and insert therefore, -- not --.

At column 3, line 10, please delete “house” and insert therefore, -- houses --.

At column 3, line 31 (Approx.), please delete “therof” and insert therefore, -- thereof --.

At column 4, line 53, before “(either” please delete “when the cowling”.

At column 4, line 54, after “within the cowling 10”, please delete “,” and insert therefore, -- ) --.

At column 7, line 20, after “cross”, please delete “to” and insert therefore, -- section fitted onto --.

At column 7, line 25 (Approx.), after “an”, please insert therefore, -- opening so that --.

At column 7, line 40 (Approx.), after “such”, please insert therefore, -- that the integral --.

At column 10, line 3, in Claim 9, please delete “water tight” and insert therefore, -- watertight --.

Signed and Sealed this

Seventh Day of July, 2009

John Doll

JOHN DOLL
*Acting Director of the United States Patent and Trademark Office*